US010314419B2

(12) United States Patent
Archibald

(10) Patent No.: US 10,314,419 B2
(45) Date of Patent: Jun. 11, 2019

(54) CHARM BLANKET

(71) Applicant: Margaret Jane Archibald, Ottawa (CA)

(72) Inventor: Margaret Jane Archibald, Ottawa (CA)

( * ) Notice: Subject to any disclaimer, the term of this patent is extended or adjusted under 35 U.S.C. 154(b) by 0 days.

(21) Appl. No.: 15/852,707

(22) Filed: Dec. 22, 2017

(65) Prior Publication Data

US 2018/0177314 A1 Jun. 28, 2018

(30) Foreign Application Priority Data

Dec. 22, 2016 (CA) ..... 2952715

(51) Int. Cl.

| | |
|---|---|
| ***A47G 9/10*** | (2006.01) |
| ***A47G 33/00*** | (2006.01) |
| ***A47D 15/00*** | (2006.01) |
| ***A47G 9/02*** | (2006.01) |

(52) U.S. Cl.

CPC ..... *A47G 9/1045* (2013.01); *A47D 15/00* (2013.01); *A47G 9/0223* (2013.01); *A47G 33/004* (2013.01)

(58) Field of Classification Search

CPC ..... A47G 9/02; A47G 9/0238; A47G 9/0207; D10B 2503/06

See application file for complete search history.

(56) References Cited

U.S. PATENT DOCUMENTS 1,474,738 A * 11/1923 Thierjung ..... A47G 9/04 5/494
2,677,834 A * 5/1954 Moynihan ..... A47G 9/0207 128/872
4,949,415 A * 8/1990 Selga ..... A47G 9/0207 40/124.01
4,989,285 A * 2/1991 Troncone ..... A47D 15/00 5/482
D339,708 S * 9/1993 DeStefanis ..... D6/596
D340,379 S * 10/1993 Cain ..... 5/654
5,735,004 A * 4/1998 Wooten ..... A41B 13/06 2/69
6,684,422 B2 * 2/2004 LeFevre ..... A47G 9/0223 2/69
6,769,144 B1 * 8/2004 Bruske ..... A47G 9/0223 5/482
7,090,500 B1 * 8/2006 Guttman ..... G09B 19/24 434/247
D530,059 S * 10/2006 Tenenbaum ..... D2/719
(Continued)

OTHER PUBLICATIONS

"Milestone Blankets by batzkids", Feb. 8, 2016, https://web.archive.org/web/20160208171944/http://batzkids.com:80/.*

*Primary Examiner* — Eric J Kurilla

(57) ABSTRACT

A blanket which is used to mark milestone events such as events in a child's life. The blanket having a means of attaching charms along the perimeter of the blanket. The blanket is composed of an upper piece and a lower piece sewn together to create an open area between the two pieces along the perimeter of the blanket. The open area having connectors, such as hook and loop fasteners, sewn in it such that charms may be attached to the connectors between the upper and lower pieces or the upper and lower pieces may be attached to each other while no charm is present. The charms may be ribbons, or other objects made of material which is safe for children. The blanket may have calendar, time line, or age markings along the perimeter such that charms may be attached to the connectors at the corresponding age or date when the event occurred.

12 Claims, 1 Drawing Sheet

(56) References Cited

U.S. PATENT DOCUMENTS

| | | | | |
|---|---|---|---|---|
| 8,381,334 | B2 * | 2/2013 | Ballard | A47G 9/062 5/485 |
| 2002/0095725 | A1 * | 7/2002 | Dix | A47D 15/00 5/482 |
| 2011/0047697 | A1 * | 3/2011 | McBrearty | A47G 9/062 5/417 |
| 2011/0056021 | A1 * | 3/2011 | James | A47G 9/0207 5/502 |
| 2014/0283722 | A1 * | 9/2014 | Pinoli | A47G 9/0207 112/441 |

* cited by examiner

CHARM BLANKET

FIELD OF THE INVENTION

The invention pertains generally to a commemorative article. More specifically, the invention relates to a blanket or similar article used to commemorate milestone events, such as events in a child's life. The blanket permits various charms, which relate to events in the child's life, to be attached along the perimeter of the blanket at various locations.

BACKGROUND OF THE INVENTION

Baby blankets are well known as blankets which are typically much smaller and/or softer than other blankets. These blankets may be given to a baby by parents, relatives, or friends of the parents shortly after the baby is born. Baby blankets generally depict colorful designs and pictures to provide stimulation for the baby. The blankets often become cherished items for the baby and important mementos for the parents when the baby gets older.

In addition to the baby's blanket, parents often want to keep reminders of the first time their baby has done something new, such as first steps, first words, first play group and so forth. Typically, this is done with a scrapbook or baby memory book, which parents fill with pictures and other mementos as milestone events occur. However, scrapbooks or memory books are time consuming to prepare, and are not something the baby can interact with or enjoy until they are much older.

In the field of baby blankets, U.S. Pat. No. RE38,782 E to Dix discloses a blanket which is composed of two pieces sewn on top of each other with various ribbon loops sewn between the pieces along the perimeter. These ribbons are made of various materials in various colours and designs to provide visual, auditory, and tactile stimulation for the baby. This design for a blanket provides some stimulation for the baby but sewing the ribbons directly into the blanket does not permit those ribbons to be changed from preset positions. The ribbons also only serve to provide additional stimulation and do not enable the blanket to act as a personalized keepsake for both parents and children. In other words, once a child outgrows the blanket of RE 32782, it is no further use.

Accordingly, the object of the present invention is to provide a blanket, such as a baby blanket which can commemorate milestone events in the baby's life in a way that is unique to each baby's blanket.

SUMMARY OF THE INVENTION

The charm blanket of the present invention, such as the baby charm blanket is designed for parents to uniquely and easily record the significant milestones in a baby or child's life. It is a combination of a blanket and a baby memory book. Individual charms made of ribbons or other small objects suitable for babies are attached to the baby charm blanket to mark milestones as they occur.

The charms may depict words, phrases, or pictures related to the milestones. Other charms may be shapes which are relevant to the milestones, such as a tooth for the baby's first tooth. These shapes may be crafted out of plastic, rubber, silicon, wood or other baby safe materials.

The blanket may depict a time line, a calendar with dates or the baby's age along the perimeter of the blanket such that the charms may be attached at the appropriate date or age that the milestone event occurred.

The baby charm blanket is a safe and practical article which may be hung on the wall or given to the baby to play with which is personalized and unique to each baby. The baby charm blanket provides a means to remember important events in a baby's life which the baby can also enjoy and be stimulated by at the same time.

In some embodiments, the present invention provides a commemorative article in the form of a blanket or pillow comprising a fabric body, fasteners attached to the fabric body, and commemorative charms which may be removably attached to the fasteners, wherein the commemorative charms depict milestone events.

In some embodiments, the fasteners may be hook and loop fasteners which connect to hook and loop fasteners on the charms.

In some embodiments, the fabric body may be composed of a top piece and a bottom piece, wherein the hook and loop fasteners may be sewn along the perimeter of the fabric body to the interior side of each piece; and the top and bottom pieces may be sewn together further towards the center of the fabric body than the hook and loop fasteners.

In some embodiments, the charms may be connected to the fabric body by connecting the hook and loop fasteners of the top piece of the fabric body to a top side of the charm and connecting the hook and loop fasteners of the bottom piece of the fabric body to a bottom side of the charm.

In some embodiments, the fabric body may depict a calendar around a perimeter of the fabric body and the milestone events may be events in a baby's life. In some embodiments, the calendar may depict the amount of time since the baby's birth. In some embodiments, the calendar may provide spaces corresponding to the months of the year.

In some embodiments, the charms may be ribbons which depict words, phrases or pictures related to a milestone in a baby's life. In some embodiments, the charms may be objects made of plastic, rubber, silicon, wood, or materials suitable for babies in shapes which relate to a milestone event in the baby's life.

The foregoing summary is illustrative only and is not intended to be in any way limiting. Other aspects and features of the present invention will become apparent to those of ordinary skill in the art upon review of the following description of embodiments of the invention in conjunction with the accompanying figures and claims.

BRIEF DESCRIPTION OF THE DRAWINGS

In the drawings which illustrate by way of example only embodiments of the invention.

DETAILED DESCRIPTION OF THE PREFERRED EMBODIMENT

Figure 1:
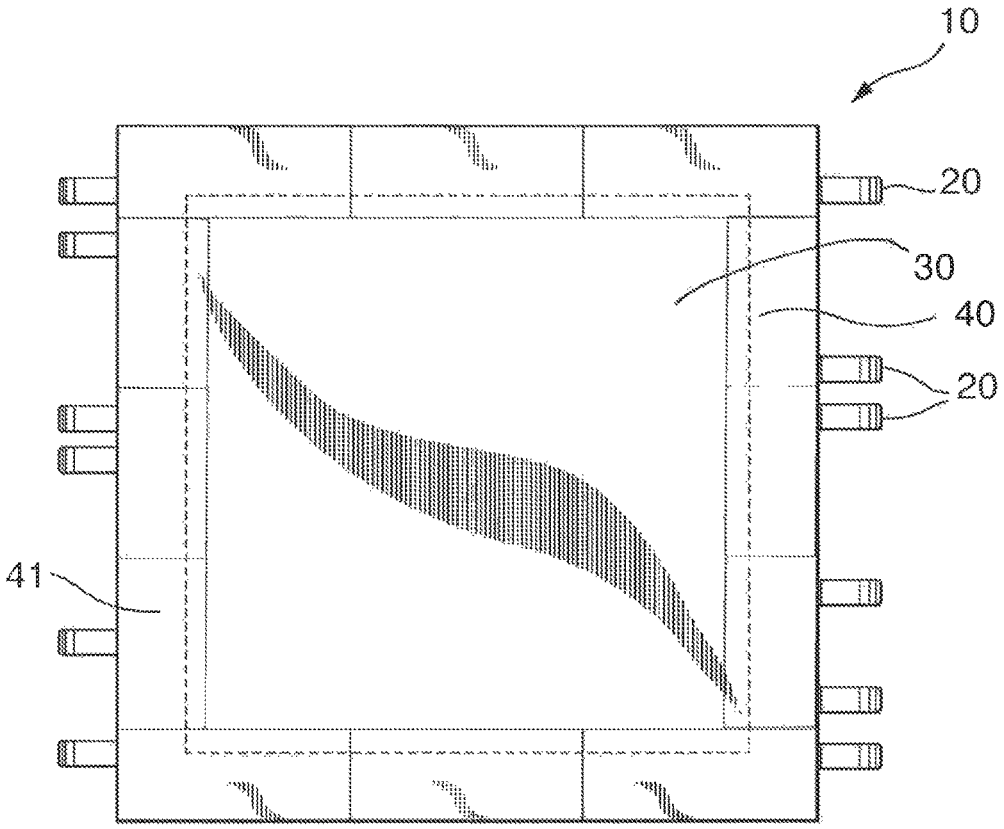
FIG. 1 is a top plan view of the blanket of the present invention with various ribbon charms attached along a perimeter calendar.
Figure 2:
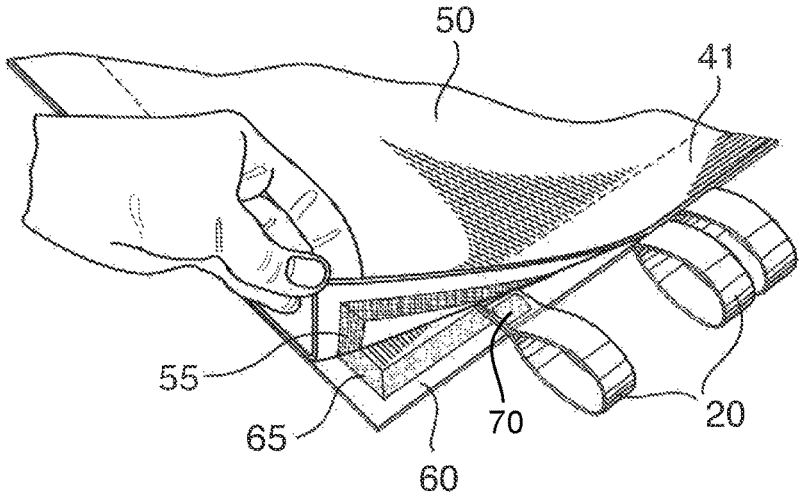
FIG. 2 is a perspective view of the charms being attached to the blanket of the present invention.

With reference to FIGS. 1-2, preferred embodiments of a charm blanket according to the present invention, such as baby charm blanket 10, will now be described. According to a preferred embodiment of the present invention, the baby charm blanket 10 is approximately 30 inches by 30 inches. In the preferred embodiment illustrated in the drawings, blanket 10 is made of two layers of fabric such as a woven or non-woven fabric. The outer surface of one of the layers is the front surface of the blanket, and may be provided with an aesthetically pleasing graphic design. Typical designs may be animals, castles, licensed characters or the like. The outer surface of the other layer may be provided with a design, or it may be blank. Both layers may be made of any suitable material such as woven or non-woven cotton, polyester or other fabric, felt, vinyl coated cloth, vinyl, leather, or any composite thereof or other suitable material as will be a matter of choice for one skilled in the art. The two layers are joined together around their perimeters as described below.

In a preferred embodiment, a calendar grid 40 is provided around the perimeter of the front surface of the blanket. For instance, a border of about 2 inches may be delineated around the perimeter, with the border divided into either 12 equal sized rectangles, each one representing a month, or 52 equal sized spaces, each one representing a week. In this regard, it will be appreciated that other arrangements are possible and certainly within the scope of the present invention. For instance, the perimeter may be divided into rectangles of size proportionate to the length of each month, and labelled, January, February etc., with January situated, for instance, in the lower right corner of the perimeter, and the months arranged clockwise around the blanket.

If a grid of equal rectangles numbered 1 to 12 or 1 to 52 as described above is provided, the beginning of the first space is labelled "born", "new born", or similar. The end of the last space can likewise be labelled "first birthday" or words to that effect.

The top and bottom layers of the blanket may be sewn together by a seam extending around the inner edge of the perimeter grid, as shown in FIG. 2. This seam will keep the top and bottom layers of the blanket nicely aligned, but will permit the outer edges of the top and bottom layers, held together as described below preferably by a hook and loop fastener tape such as Velcro™, to be separated for the insertion of charms in any desired location around the perimeter. It will be appreciated, however, that this perimeter seam is not absolutely necessary, and one may rely entirely on the fastener tape around the perimeter to hold the layers together.

The top and bottom pieces 50, 60 will each have a ⅝ inch soft and flexible sew-on hook and loop fasteners 55, 65 sewn ¼ inch inside the edges of the top and bottom pieces 50, 60. The hook fastener may be on the top piece 50 and the loop fastener may be on the bottom piece 60. When the top piece 50 and the bottom piece 60 are put together the hook and loop fasteners 55, 65 match up inside the blanket, holding the perimeter of the top and bottom pieces 50, 60 together.

Behind the inner most edge of the hook and loop fasteners 55, 65 is approximately a 1-inch space before perimeter seam 41 is sewn around the entire perimeter of the top piece 50 of the material, lining up with the edge of the calendar border 40. This seam 41 may attach a piece of light-weight cotton, polyester, or other suitable batting to the inside of the blanket 10, making it slightly puffier and softer to the touch, and also offsetting the thickness of the hook and loop fasteners 55, 65 and the charms 20 once the charms 20 are inserted between the top and bottom pieces 50, 60.

The charms 20 are pieces of customized ribbon, cord, or the like with a word, phrase, or picture in the center, indicating the milestone, or small objects made of plastic, rubber, silicon, wood, or other material suitable for babies, in a shape relevant to the milestone (not pictured).

Each ribbon charm 20 will typically be approximately 3'/4 inch in length and 1 inch wide, but other sizes and shapes of ribbon charms are possible, and within the scope of the present invention. At the end of each charm 20 there is ⅝ inch soft and flexible hook and loop fasteners 70 sewn onto each side. For ribbon charms 20, loop fasteners may be on the front of the charm (same side as the words or pictures appear) and hook fasteners are on the back of the charm. This design ensures that the information on the ribbon charm 20 is visible on the same side of the blanket 10 as the calendar 40 and that the hook and loop fasteners of the blanket 10 match the hook and loop fasteners of the charms 20. This arrangement may, of course be reversed.

For the embodiment described above, each piece of ribbon may be about 6 inches long, folded in half to make a ribbon charm 20. As a result of the ⅝-inch hook and loop fasteners and the ¼ inch space inside the edge of the baby charm blanket 10, once a ribbon charm 20 is connected, only part of the ribbon charm 20 will be showing. The ribbon charms 20 are available in many different colors and patterns and made of a mix of grosgrain and satin ribbons. Ribbon charms 20 may feature words such as "tooth", "laugh", "stack blocks" or other phrases relevant to events in a baby's first year that parents wish to commemorate.

For instance, appropriate charms, either in the form of ribbons, or small plastic mementos may be provided for the following events in a baby's first year:

Baby's First:

1. Smile
2. Laugh
3. Babble
4. Roll Over
5. Grasp Toy
6. Sit Up
7. Sippy Cup
8. Solid Food
9. Crawl
10. Stand with Help
11. Stand without Help
12. Wave
13. Clap Hands
14. Word
15. Climb Stairs
16. Finger Feed
17. Stack Blocks
18. "Mama"
19. "Dada"
20. Tooth
21. Haircut
22. Walk with Help
23. Walk without Help
24. Peek-a-Boo
25. Vacation
26. Swim
27. Snow
28. Full Sleep
29. Overnight Away
30. Play Group Each charm will be placed in the space corresponding to the month or week in which the event occurred, and secured to the hook and loop fasteners 55, 65 of the blanket 10 by the charm's complementary hook and loop fasteners 70.

Other embodiments of the present invention may use different fasteners such as snaps, buttons or the like for the charms, a different marking scheme around the perimeter, different materials for the blanket, different materials for the charms, or may be a single blanket piece rather than two pieces sewn together. Other blanket constructions will be obvious to a person skilled in the art. Other embodiments may also use different sizes and placements of the various components. In each instance, the blanket or similar article will permit commemorative objects to be attached to the article as milestones in the baby or child's life occur. Other purposed blankets will be obvious to a person skilled in the art, such as blankets for pets or other commemorative purposes.

Although the baby charm blanket has been illustrated as being made of particular materials and in a particular shape, one of ordinary skill in the art will appreciate that certain changes could be made without departing from the scope of the invention. For example, the blanket could be round or made of fleece, or permit charms to be attached to a more central area of the blanket. Alternatively, the "blanket" may be more stuffed, like a pillow, or have the shape of a stuffed animal.

Since certain changes (including those listed above) may be made in the above described baby charm blanket without departing from the scope of the invention, it is intended that all subject matter of the above description and in the accompanying drawings be interpreted merely as examples of the invention herein and shall not be construed as limiting the invention.

What is claimed:

1. A commemorative article in the form of a blanket or pillow comprising:

a. a fabric body composed of a top piece and a bottom piece;

b. fasteners attached along the perimeter of the fabric body to the interior side of each piece; and a. commemorative charms removably attached to the fasteners, wherein the commemorative charms depict milestone events.

2. The article of claim 1, wherein the fabric body depicts a calendar around a perimeter of the fabric body and the milestone events are events in a baby's life.

3. The article of claim 2, wherein the calendar depicts the amount of time since the baby's birth.

4. The article of claim 2, wherein the calendar provides spaces corresponding to the months of the year.

5. The article of claim 1, wherein the fasteners are hook and loop fasteners which connect to hook and loop fasteners on the charms.

6. The article of claim 5, wherein a. the hook and loop fasteners are sewn along the perimeter of the fabric body to the interior side of each piece; and b. the top and bottom pieces are sewn together further towards the center of the fabric body than the hook and loop fasteners.

7. The article of claim 6, wherein the charms can be connected to the fabric body by connecting the hook and loop fasteners of the top piece of the fabric body to a top side of the charm and connecting the hook and loop fasteners of the bottom piece of the fabric body to a bottom side of the charm.

8. The article of claim 7, wherein the charms are ribbons which depict words, phrases or pictures related to a milestone in a baby's life.

9. The article of claim 7, wherein the charms are objects made of plastic, rubber, silicon, wood, or materials suitable for babies in shapes which relate to a milestone event in the baby's life.

10. The article of claim 7, wherein the fabric body depicts a calendar around a perimeter of the fabric body and the milestone events are events in a baby's life.

11. The article of claim 10, wherein the calendar depicts the amount of time since the baby's birth.

12. The article of claim 10, wherein the calendar provides spaces corresponding to the months of the year.

* * * * *